United States Patent [19]

Chapront

[11] 4,126,028

[45] Nov. 21, 1978

[54] METHOD AND APPARATUS FOR STRESSLESS ROLLING OF METALS

[75] Inventor: Pierre A. Chapront, Montmorency, France

[73] Assignee: Jeumont-Schneider, Puteaux, France

[21] Appl. No.: 805,544

[22] Filed: Jun. 10, 1977

[30] Foreign Application Priority Data

Jun. 11, 1976 [FR] France ..... 76 17659

[51] Int. Cl.[2] ..... B21B 37/00

[52] U.S. Cl. ..... 72/19

[58] Field of Search ..... 72/6, 8–10, 72/11, 12, 14, 234, 19

[56] References Cited

U.S. PATENT DOCUMENTS

| | | | |
|---|---|---|---|
| 3,363,441 | 1/1968 | Smith, Jr. | 72/8 |
| 3,457,747 | 7/1969 | Yeomans | 72/234 X |

*Primary Examiner*—Milton S. Mehr

*Attorney, Agent, or Firm*—J. J. Wood

[57] ABSTRACT

A method and apparatus are disclosed for the stressless rolling of metals in a continuous rolling mill. In a continuous train, between any two successive mill stands, the magnitude of the rolling torque in the first mill stand is measured and stored just before the metal enters the second mill stand. The rolling torque of the first stand is maintained constant at the stored magnitude until the speed of the first stand is stabilized. Immediately after stabilization is achieved, the ratio of the speeds of the first and second mill stand is held constant until rolling is ended.

4 Claims, 2 Drawing Figures

METHOD AND APPARATUS FOR STRESSLESS ROLLING OF METALS

BACKGROUND OF THE INVENTION

1. Field of the Invention

This invention relates to a method and apparatus for the stressless rolling of metals in a continuous mill train.

2. Description of the Prior Art

During the rolling of elongated products (round iron, shaped sections, rails, girders) in continuous rolling mill trains, where the product is simultaneously held in several rolling stands, the presence of a tractive force (tensive or compressive) between the stands causes distortions to occur in the required profile, and should consequently be minimized or, better still, completely eliminated.

In the case of roughing mill trains, a certain tension is maintained, which is held approximately constant by giving the drive motors an intentionally falling speed-torque characteristic.

The occurrence of tension in finishing mill trains can be prevented by allowing the product to form a loop between stands, and by regulating the speed of each stand, adjusting the height of the corresponding loop.

These procedures, however, are not entirely satisfactory because they cannot be applied with the same success to all types of product.

SUMMARY OF THE INVENTION

The invention discloses a method and apparatus for the stressless rolling of metals passing successively through at least a pair of first and second rolling mill stands. Just before the metal enters the second mill stand, the magnitude of the rolling torque in the first mill stand is measured and stored. The rolling torque of the first stand is held constant at this stored torque magnitude until the speed of the first mill stand is stabilized. Immediately after stabilization, the ratio of the speeds of the first and second mill stands is held constant until rolling is ended.

GENERAL CONSIDERATIONS

Figure 1:
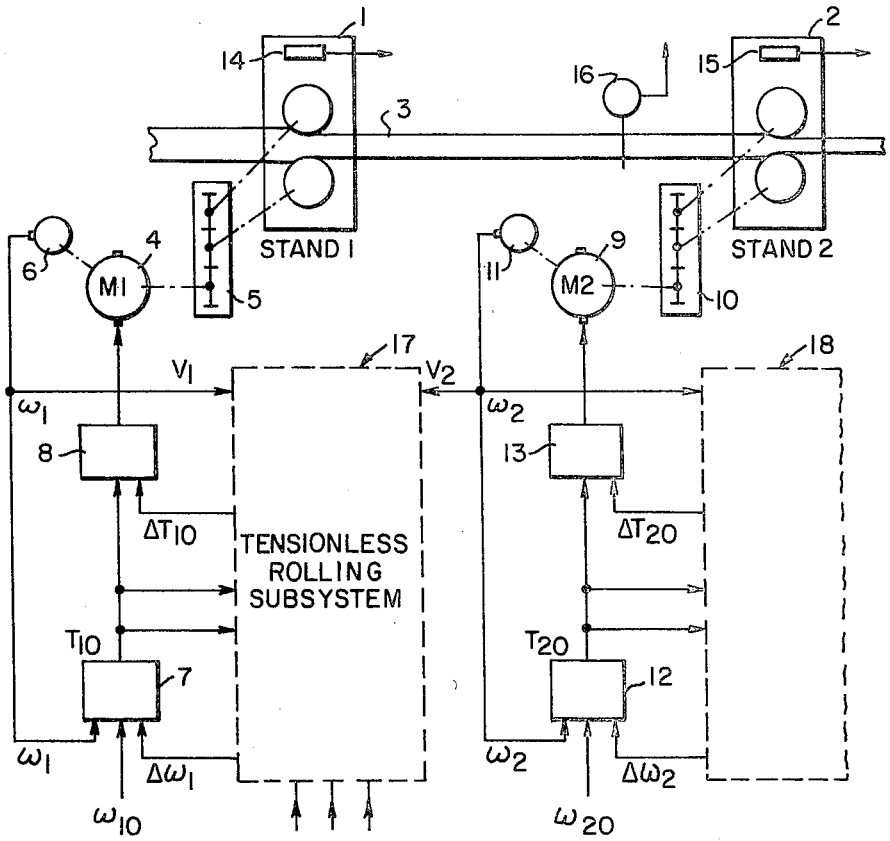
FIG. 1 is a block diagram illustrating the stressless rolling of metallic work pieces in accordance with the invention.

The process to be described concerns control of the motors for the stands of a continuous rolling train, the control being such that the tension applied to the product between the stands is as small as possible, making the presence of a loop unnecessary.

In the case of a single stand, for example, when rolling without tension, it is known that, for a given grooved section, a given roll-gap, a given input cross-section and a given product temperature, there is a set of quantities (rolling torque $T_o$, rotational speed of the rollers $\omega_o$, output speed of the product) which are perfectly defined and connected in a complex, but rigorous manner with the slipping areas of the product on the rolls. The contact area can, in effect, be resolved into three component areas:

(a) an upstream slipping area where the product slips on the roller at a speed which is less than the tangential speed of the surface element;

(b) a neutral area where there is no slippage; and (c) a downstream slipping area where the product slips on the roller at a speed greater than the tangential speed of the surface element.

For a given output rate, the rolling torque $T_o$ and the speed $\omega_o$ depend solely on the position of the neutral surface which delimits the important regions relative to the upstream and downstream slipping surfaces.

In the following discussion, rolling parameters will be designated as: the temperature, the chemical composition, the weight per linear meter, and the geometrical dimensions of the cross-section of the product to be rolled taken at its entry into a stand.

In the event that a rolling parameter should vary, in order to obtain the same output rate while retaining the rolling torque, it is necessary to adjust either a tension or a counter-tension, (depending on the type of variation envisaged), in such a way as to compensate for the shift in the neutral zone, to which there also corresponds a variation in the speed of the stand.

If two consecutive rolling stands are considered, which are assumed to be in equilibrium, the rolling torque of the stand 1 will be $T_{10}$ and its rotational speed will be $\omega_{10}$, the torque of stand 2 will be $T_{20}$ and its rotational speed $\omega_{20}$.

It will be assumed that this equilibrium state corresponds to a rolling operation in which there is no tension between the stands. If a rolling parameter should vary, and if the rolling torque of the first stand is artificially maintained at its initial value $T_o$, the second stand, if its speed $\omega_{20}$ is artificially maintained, should provide a tension or a counter-tension (thrust) which is such that the state of equilibrium is preserved. The first stand will thus turn at a speed $\omega'_{10}$ which is different from its initial speed $\omega_{10}$. The difference between the speed ratios $(\omega'_{10}/\omega_{20}) - (\omega_{10}/\omega_{20})$ is a continuous and monotonous function of the tension or counter-tension. When this difference is zero, there is no stress (or strain) in the metal. The regulation process, which is the concern of the present invention, stems directly from this relationship. The process in accordance with the invention, which is applicable to two successive stands in a rolling train, involves the use, for each stand, of a torque regulator and a three input speed regulator with a tachometer, the output of the speed regulator serving as the principal reference to the torque regulator, the process being characterized by the fact that:

(a) just before the metal is introduced into the second rolling stand, the magnitude of the rolling torque of the first stand is measured and recorded;

(b) after the metal has been introduced into the second stand, the magnitude of the rolling torque in the first stand is held constant by acting on the speed reference of the speed regulator of the first stand until the speed of the first stand is stabilized; and (c) immediately afterwards, and until the rolling operation is finished, the ratio of the speeds of the two stands is held constant by acting on the principal reference of the torque regulator for the first stand.

The apparatus for putting this process into effect is characterized by the fact that it incorporates the following:

(a) means for detecting, in succession, the entry of the metal into the first stand, its proximity to the entry into the second stand and its passage into the second stand;

(b) a control logic with three inputs which respectively receive the signals emitted by the said means of detection;

(c) a regulator for the principal reference for the torque controller associated with the first stand, the said principal reference regulator having its four inputs respectively connected to the output of the speed regulator for the first stand, to the control logic, to a circuit which computes the rolling torque for the first stand, via a storage unit (or memory) for registering the said rolling torque, the storage unit being connected to the control logic and, finally, to the output of a differentiating circuit whose output is connected to the third input of the speed regulator for the first stand, the said rolling torque computing circuit having its two inputs connected respectively to the output of the said differentiating circuit and to the output of the speed regulator for the first stand; and (d) a regulator of the ratio of the speeds of the two stands, a first input to this regulator being connected to the control logic, while two other inputs are connected, one to the output of the tachometer associated with the first stand speed regulator through an adaption and filtering circuit, while the other is connected to the output of the tachometer associated with the second stand through a circuit for determining the ratio of the speeds of the two stands and the said adaption and filtering circuit, the output of the said two stand speed ratio regulator being connected to an input of the first stand torque regulator to provide an incremental control signal $\Delta T_{10}$.

DESCRIPTION OF THE PREFERRED EMBODIMENT

Referring now to FIG. 1, two successive rolling mill stands are identified at 1 and 2 for rolling a metallic work piece 3. The rollers of stand 1 are driven by a motor 4 through gearing 5. A tachometer 6, driven by the motor 4, transmits a speed signal $\omega_1(V_1)$ to a first input, (unnumbered) of a speed regulator 7 associated with stand 1. The speed regulator 7 has three inputs: $\omega_1$, $\omega_{10}$ (the speed reference) and $\Delta\omega_1$.

A torque regulator 8 for the first stand receives the output $T_{10}$ of the speed regulator 7.

Similarly, the rollers of stand 2 are driven by a motor 9 through gearing 10. A tachometer 11 is coupled to the motor 9 and transmits signal $\omega_2(V_2)$. The speed regulator and the torque regulator are identified at 12 and 13 respectively.

The motors associated with these stands are energized by conventionally controlled apparatus which incorporates an internal torque regulating loop and an external speed regulating loop, the output of the speed regulator ($T_{10}$ or $T_{20}$) serving as the principal reference for the torque regulator (8 or 13) respectively.

Two detectors which may for example comprise strain gauges, identified at 14 and 15 respectively, identify the passage of the metallic work piece through mill stands 1 and 2. A detector which may for example be a photoelectric cell, identified at 16, serves to detect the passage of the metal 3 close to the entrance to the second mill stand 2.

Figure 2:
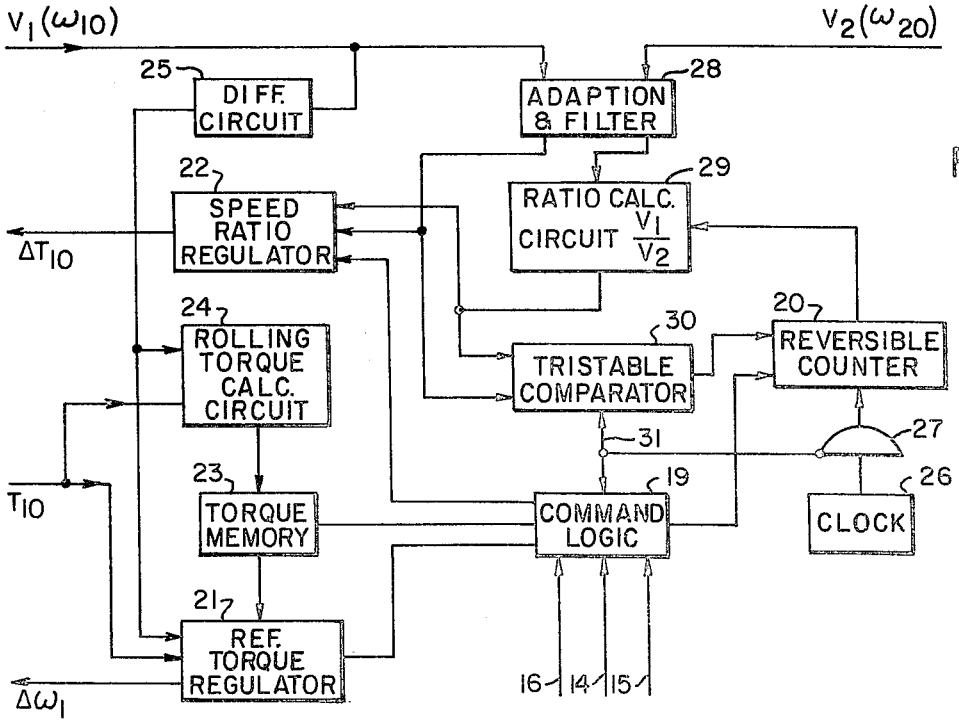
FIG. 2 is a block diagram of the tensionless rolling subsystem utilized in the FIG. 1 embodiment in accordance with the invention.

The regulators associated with motor 4 are controlled by the tensionless rolling subsystem indicated generally at 17 in FIG. 1, and depicted in detail in FIG. 2; a similar subsystem indicated generally at 18 serves motor 9.

Referring now to FIG. 2, the outputs transmitted by the strain gauges 14 and 15 are transmitted to a command logic indicated symbolically at 19, which also receives the information transmitted by the photocell 16. Strain gauges or any other devices sensitive to rolling pressure may be used to generate a logic signal indicative of the presence of the product 3 in the stands. Similarly, the logic signal produced by the photocell 16 may be generated by any similar device indicating the presence of the product 3 in the immediate vicinity of the entrance to stand 2. Since the speed of the product is known approximately, all that is necessary is a simple measurement of time which is inversely proportional to speed.

Before the product 3 enters stand 1, the command logic 19:

(a) maintains a reversible counter 20 at zero;

(b) blocks a reference torque regulator 21 by setting the gain to zero;

(c) blocks a speed ratio regulator 22 by setting the gain to zero; and (d) sets a torque memory or storage circuit 23 at zero.

When the strain gauge (logic signal at 14) indicates that the product 3 is in stand 1, the command logic 19 enables the memory 23 to receive the instantaneous rolling torque magnitude from a rolling torque calculating circuit 24. The reference torque regulator 21 is still blocked i.e., $\Delta\omega_1 = 0$. The rolling torque calculator 24 is an operational amplifier which receives the inputs $T_{10}$ from the speed regulator 7 and a derivative of speed signal $d(\omega)/d\ t$ from a differentiating circuit 25. The differentiator 25 is an operational amplifier connected to perform differentiation on the input signal $\omega_1(V_1)$.

When the product 3 arrives at the entrance of stand 2, the photocell 16 sends a logic signal to command logic 19 which then blocks the memory 23, thus preserving the rolling torque magnitude $T_{10}$ in the memory 23, which magnitude ($T_{10}$) represents the magnitude of the rolling torque in the absence of a tractive force (tensive or compressive) between the stands. When the work product 3 enters stand 2, which event is signalled by strain gauge 15, the command logic unblocks the reference torque regulator 21, which outputs a corrective term $\Delta\omega_1$ which enables the torque of stand 1 to be equal to the magnitude in the memory 23. The input from the differentiating circuitry 25 makes it possible for the torque regulator 21 to eliminate any errors resulting from the inertia of masses in motion. Thus the speed of stand 1 is adjusted to that of stand 2 in such a way that the torque is one which corresponds to an absence of tractive force.

At the same time as the memory 23 is unblocked, the command logic 19 releases the reversible counter 20 which then begins to count as a result of the impulses from a clock 26 passing through a logic gate 27. The voltage $V_2$ which represents the speed $\omega_{20}$ is applied to adaption and filtering circuit 28, the output of which is applied to a ratio calculating circuit 29, which is really an analog to digital converter for calculating the ratio $V_1/V_2$. The digital state of counter 20 is applied to the ratio detecting circuit 29 to balance the voltage $V_2$. A tristable comparator 30 which has three stable inputs, compares this balanced value with the value $V_1$ (representing $\omega_{10}$) which is applied through adaption and filter circuit 28, and causes reversible counter 20 to count up or down until these two values are equal. Thus the final state of the counter 20 represents the ratio of the voltages $V_1$ and $V_2$.

A very short instant of time after the product 3 has entered stand 2, is sufficient for the ratio $V_1$ and $V_2$ to be registered in the counter 20 (confirmed by the connection 31 between the tristable comparator 30 and the command logic 19); the control logic 19 unblocks the speed ratio regulator 22. The short time delay necessary for registration is included in the control logic 19.

The speed ratio regulator 22 receives the signal $V_1$ (through adaption and filtering circuit 28) and the signal $V_2$ (weighted by the ratio calculating circuit 29 to the magnitude registered in the counter 20), and develops an incremental signal $\Delta T_{10}$ which is applied as a correction to torque regulator 8 to enable the speed ratio to be held constant.

Thus any modification of a parameter which tends to introduce a tractive force between these two stands will be compensated for by keeping constant the ratio of the speeds of the two stands $\omega_{10}/\omega_{20}$ calculated at the instant the product 3 is introduced into the stands in an unstressed state.

In the case of several consecutive stands, the process is repeated at each successive stand.

It should be noted that in those situations where a computer is used, the latter would perform the functions already described in the above embodiment by the control logic 19 which acts as a general control for the system. The computer can also carry out the function of components 30, 29, 20 and 26 for measuring and storing in the memory the speed ratios, the speed being advantageously measured so as to produce impulses (by means of the computer) which are emitted by pulse generators associated with the tachometers which will still be retained as analog controllers.

I claim:

1. A method for the stressless rolling of metals passing successively through at least a pair of first and second rolling mill stands, the method comprising the steps of:

measuring and storing the magnitude of the rolling torque in the first mill stand, just before the metal enters the second mill stand;

maintaining the rolling torque of the first stand constant at said stored magnitude until the speed of the first mill stand is stabilized; and maintaining the ratio of the speeds of the first and second mill stands constant immediately after stabilization, and until rolling is ended.

2. A method for the stressless rolling of metals passing successively through at least a pair of first and second rolling mill stands, the method comprising the steps of:

measuring the rolling torque in the first mill stand as the metal enters the first stand;

storing the instantaneous magnitude of said rolling torque;

detecting when the metal is in proximity to said second mill stand, and then fixing the magnitude of the stored rolling torque;

detecting when the metal enters the second stand;

maintaining the rolling torque of the first stand constant at the magnitude of said stored rolling torque until the speed of the first mill stand is stabilized; and maintaining the ratio of the speeds of the first and second mill stands constant, immediately after stabilization, through and until rolling is ended.

3. Apparatus for the stressless rolling of a metallic work piece passing successively through at least a pair of first and second rolling mill stands comprising:

means for detecting the entry of the work piece into the first mill stand for delivering a first detection signal;

means for detecting the approach of the work piece to a position close to the second mill stand for delivering a second detection signal;

means for detecting the actual entry of the work piece into the second mill stand for delivering a third detection signal;

logic means having three inputs for receiving said detection signals in first, second and third ordered sequence, and first, second and third outputs;

torque regulator means for the first mill stand having first, second and third inputs, the first input receiving the reference torque signal;

speed regulator means having first, second and third inputs and an output connected to the second input of said torque regulator for providing a principal reference control signal, the second input of said speed regulator means being connected to receive a speed reference signal;

memory means having first and second inputs and an output, the first input being connected to the third output of said logic means;

rolling torque computing means having first and second inputs and an output connected to the second input of said memory means, the first input of said rolling torque computing means being connected to the output of said speed regulator means;

differentiating means for enabling the rolling torque computing means to eliminate errors resulting from the inertia of moving masses during the calculation of the rolling torque for the first stand, the output of said differentiating means being connected to the second input of said rolling torque computing means;

first regulator means having an ouput for delivering a correction factor signal to the third input of said speed regulator means, and four inputs, the first input being connected to the output of said speed regulator means, the second input being connected to the second output of said logic means, the third input being connected to the output of said memory means, the fourth input being connected to the output of said differentiating means;

an adaption and filtering circuit having first and second inputs, and first and second outputs;

a first tachometer for the first stand having an output connected to the first input of said speed regulator means and to the second input of said adaption and filtering circuit;

a second tachometer for the second stand having an output connected to the first input of said adaption and filtering circuit;

ratio determining means having an input connected to the first output of said adaption and filtering circuit, and an output;

second regulator means for regulating the ratio of the speeds of said two rolling stands, having three inputs and an output, the first input being connected to the first output of said logic means, the second input being connected to the second output of said adaption and filtering circuit, the third input being connected to the output of said ratio determining means, the output of said second regulator being connected to the third input of said torque regulator means.

4. Apparatus according to claim 3 wherein said means for detecting the entry of the work piece into the first mill stand is a strain gauge;

said means for detecting the actual entry of the work piece into the second mill stand is a strain gauge; and said means for detecting the approach of the work piece to a position close to the second mill stand is a photoelectric cell.

* * * * *